US007331268B1

(12) United States Patent
Pangilinan et al.

(10) Patent No.: US 7,331,268 B1
(45) Date of Patent: Feb. 19, 2008

(54) EXPLOSIVE NEUTRALIZATION METHOD AND DEVICE

(75) Inventors: Gerardo I. Pangilinan, Alexandria, VA (US); Thomas P. Russell, Manasses, VA (US); Von H. Whitley, Washington, DC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 298 days.

(21) Appl. No.: 10/863,842

(22) Filed: Jun. 2, 2004

(51) Int. Cl.
*F42B 33/06* (2006.01)

(52) U.S. Cl. ..... 86/50; 102/305; 588/403

(58) Field of Classification Search ..... 102/402, 102/403, 475, 305, 306, 307, 476; 86/50; 89/1.13; 588/301, 311, 403
See application file for complete search history.

(56) References Cited

U.S. PATENT DOCUMENTS

| | | | | |
|---|---|---|---|---|
| 2,587,243 | A * | 2/1952 | Sweetman | 102/307 |
| 3,090,306 | A * | 5/1963 | Reuther | 102/403 |
| 3,109,369 | A | 11/1963 | Plumley | 102/1 |
| 3,117,518 | A * | 1/1964 | Porter et al. | 102/307 |
| 3,159,102 | A * | 12/1964 | Riedl et al. | 102/305 |
| 3,724,372 | A | 4/1973 | Phillips | 102/1 |
| 4,169,403 | A * | 10/1979 | Hanson | 86/50 |
| 4,601,761 | A | 7/1986 | Proctor et al. | 148/9 |
| 5,303,633 | A * | 4/1994 | Guthrie et al. | 89/8 |
| 5,790,963 | A | 8/1998 | Welham | 588/202 |
| 5,936,184 | A * | 8/1999 | Majerus et al. | 89/1.13 |
| 6,220,166 | B1 * | 4/2001 | Cherry | 102/305 |
| 6,232,519 | B1 | 5/2001 | Eidelman et al. | 588/202 |
| 6,453,788 | B1 * | 9/2002 | Lebet et al. | 86/50 |
| 6,484,617 | B1 | 11/2002 | Anderson et al. | 86/50 |
| 6,765,121 | B2 * | 7/2004 | Eidelman et al. | 588/320 |
| 6,979,758 | B2 * | 12/2005 | Eidelman et al. | 588/403 |
| 2002/0083822 | A1 | 7/2002 | Ross et al. | 89/1.13 |
| 2003/0070540 | A1 | 4/2003 | Zavitsanos et al. | 86/50 |

FOREIGN PATENT DOCUMENTS

| | | |
|---|---|---|
| DE | 3940525 | 1/1991 |
| DE | 4417763 A1 | 5/2004 |
| GR | 3022923 T | 6/1997 |

OTHER PUBLICATIONS

U.S. Appl. No. 11/239,446, filed Sep. 19, 2005, Whitley et al.

* cited by examiner

*Primary Examiner*—James S Bergin
(74) *Attorney, Agent, or Firm*—Fredric J. Zimmerman

(57) ABSTRACT

A method for neutralizing explosive ordnance is provided. According to an aspect of the method, an energetic charge is activated to produce a shockwave, which is imparted at an effective velocity and temperature on a gas to ionize the gas for creating plasma and to drive the plasma. The plasma is impacted on a casing of an ordnance containing an explosive to penetrate through the casing and, without or before causing an explosive event of explosive within the casing, substantially consume the explosive.

18 Claims, 2 Drawing Sheets

EXPLOSIVE NEUTRALIZATION METHOD AND DEVICE

GOVERNMENT LICENSING CLAUSE

The invention described herein may be manufactured and used by or for the Government of the United States of America for governmental purposes without the payment of any royalties thereon or therefore.

BACKGROUND OF THE INVENTION

1. Field of the Invention

The present invention relates to a device and method for the safe and effective neutralization of mines and other unexploded ordnances.

2. Description of Related Art

Unexploded ordnances (UXOs) present complex and widespread humanitarian problems. Intra- and inter-national conflicts involve the use of various types of explosive weapons. Sometimes weapons such as bombs, grenades, and mortars fail to function as intended during deployment, leaving behind unattended and often highly sensitive UXOs. Other latent weapons such as mines, especially landmines, may function properly, but remain inactivated during conflict. In each of these instances, the UXO/landmine presents a prevalent threat to unsuspecting civilians and military personnel.

Various techniques have been used in the destruction of mines and other UXOs. One technique is to use shaped charges for driving a jet through the outer hull of a mine and into the primary mine explosive for consuming the explosive. Shaped charge devices have the drawback of requiring relatively large loads of explosive charge, which may be used for unintended, insidious purposes if an enemy or unauthorized personnel intercepts the shaped charge. Another technique comprises injecting a chemical into a mine to exothermically burn the primary mine explosive. Drawbacks to this chemical technique include chemical compatibility limitations (i.e., the injected chemical may not be capable of safely consuming the explosive), long chemical reaction times, and aggressive delivery techniques that may place the operator in peril. Another technique known as sympathetic detonation involves detonation of an explosive device to create a shockwave for exploding nearby mines. Sympathetic detonation presents the risk of collateral damage and lacks adequate effectiveness. According to yet another technique, torches have been mounted above mines to burn through the casing and consume the explosive. However, torches may become propulsive, and have limited underwater applicability.

SUMMARY OF THE INVENTION

It is therefore an object of the present invention to provide a method and device for the safe and effective neutralization of ordnances, such as UXOs and mines, in a manner that overcomes one or more, and preferably all, of the drawbacks discussed above.

In accordance with the purposes of the invention as embodied and broadly described in this document, a first aspect of the invention provides a method for neutralizing an explosive ordnance. The method of this aspect comprises activating an energetic charge to produce a shockwave, imparting the shockwave at an effective velocity and temperature on a gas to ionize the gas for creating plasma and to drive the plasma, and impacting the plasma on a casing of an ordnance containing an explosive to penetrate through the casing and, without or before causing an explosive event of the explosive within the casing, substantially consume the explosive.

According to a second aspect of the invention, a method for neutralizing an explosive ordnance is provided. The method of the second aspect comprises activating an energetic charge having a detonation velocity of at least 7 mm/μsec to produce a shockwave, imparting the shockwave on a gas at an effective velocity of at least 6 mm/μsec and a temperature of at least 10,000° C., and impacting the gas to a casing of an ordnance containing an explosive to penetrate through the casing and, without or before causing an explosive event of the explosive within the casing, substantially consume the explosive.

A third aspect of the invention provides a device for neutralizing an unexploded ordnance. The device comprises an energetic charge having a detonation velocity of at least 7 mm/μsec, an initiator for activating the energetic charge, and an energy-focusing guide operatively associated with the energetic charge to receive a shockwave generated upon detonation of the energetic charge, the energy-focusing guide containing a gas.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF PREFERRED EMBODIMENTS AND METHODS OF THE INVENTION

Figure 1:
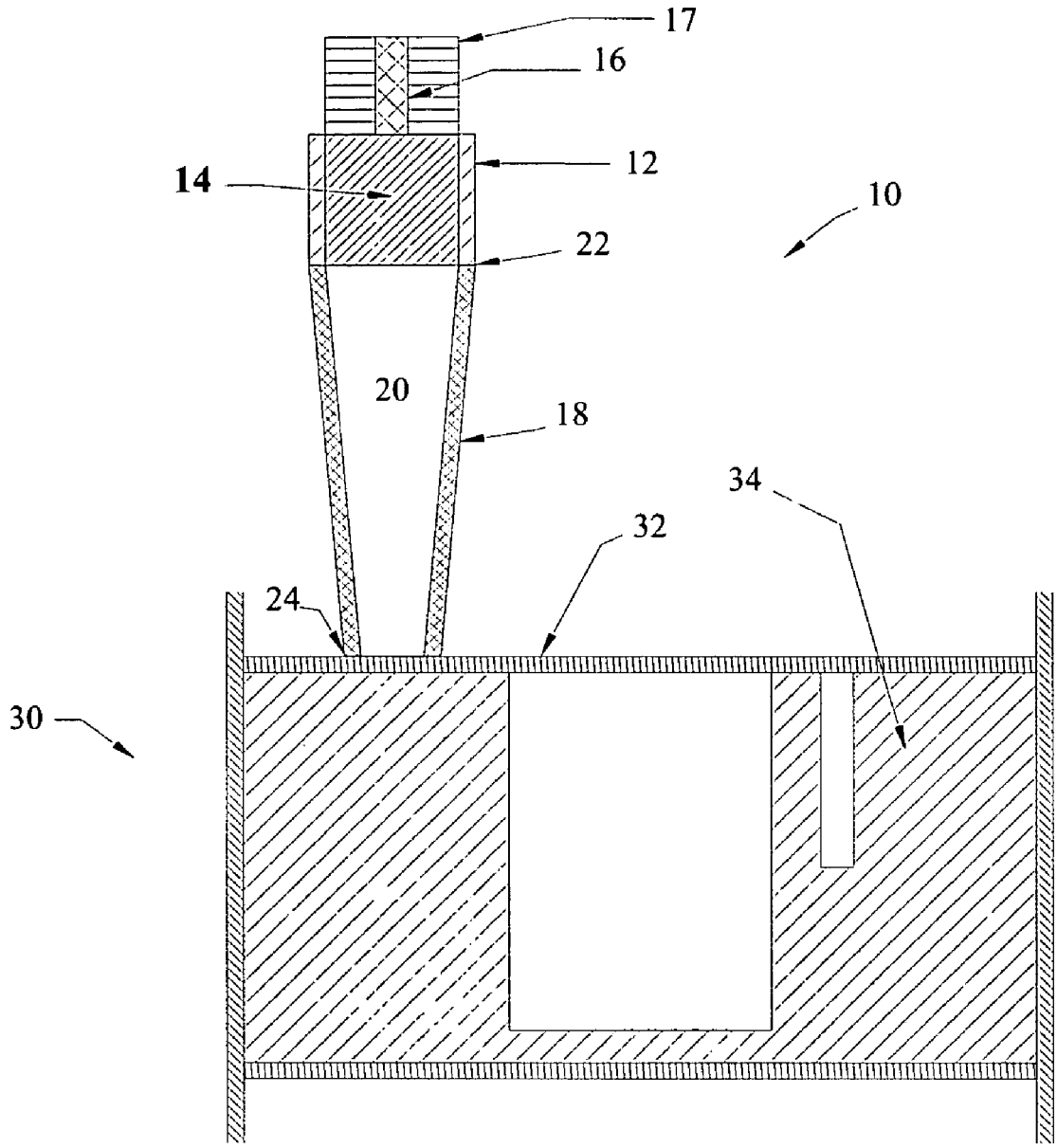
FIG. 1 is a side, cross-sectional view of a mine/UXO neutralizing device according to a first embodiment of the present invention.

Reference will now be made in detail to the presently preferred embodiments and methods of the invention as illustrated in the accompanying drawings, in which like reference characters designate like or corresponding parts throughout the drawings. For similar but not identical parts, an alphabetic suffice (e.g., "A") is used. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

Referring now more particularly to the drawings, and in particular FIG. 1, there is shown a mine/UXO-neutralizing device 10 according to a first embodiment of the invention. The device 10 comprises an energetic charge 14, optionally loaded in an optional upper housing 12. In the illustrated embodiment, the optional upper housing 12 is shaped as a cylindrical shell having a closed top end (optionally with a central aperture (not shown)) and an open lower end. The housing 12 may optionally contain a thin insulation layer.

The energetic charge 14 preferably is pressable, although castable, pourable, or other charges may be used. The energetic charge 14 preferably comprises a nitrate-containing compound, preferably in an amount of at least about 90 weight percent, more preferably at least about 94 weight percent of the total weight of the charge 14. The nitrate-containing compound may comprise one, two, three, or more nitrate groups (preferably trinitro or higher), and may be selected, for example, from one or more of the following: a nitramine, such as 1,3,5-trinitro-1,3,5-triaza-cyclohexane (RDX), 1,3,5,7-tetranitro-1,3,5,7-tetraaza-cycloocatane (HMX), and 2,4,6,8,10,12-hexanitro-2,4,6,8,10,12-hexaaza-tetracyclo-[5.5.0.0$^{5,9}$0$^{3,11}$]-dodecane (CL-20); a nitrate ester, such as pentaerythritol tetranitrate (PETN), ethylene glycol dinitrate (EGDN), nitroglycerin (NG); and/or other nitrates, such as trinitrotoluene (TNT), 1,3,5-triamino-2,4,6-trinitrobenzene (TATB), 1,1-diamino-2,2-dinitro ethane (DADNE), and 3-nitro-1,2,4-triazol-5-one (NTO); and others, such as 1,3,3-trinitroazetidine (TNAZ); and combinations.

The energetic charge optionally comprises additional ingredients, such as oxidizers, binders, curing agents, plasticizers, and less preferably small amounts of metal (e.g., aluminum) and carbon fuel. Examples of oxidizers include nitrates and perchlorates, such as ammonium perchlorate. Non-energetic binders, energetic binders, or a combination thereof may be used. The binder may be plasticized or unplasticized and may be selected from substituted or unsubstituted oxetane polymers, polyethers, and polycaprolactones. Representative binders that may be selected include, among others, hydroxy-terminated polybutadiene (HTPB), polypropylene glycol, polyethylene glycol, poly (glycidyl nitrate) (PGN), poly (nitratomethylmethyl-oxetane) ("poly-NMMO"), glycidyl azide polymer ("GAP"), diethyleneglycol triethyleneglycol nitraminodiacetic acid terpolymer ("9DT-NIDA"), poly(bisazidomethyl-oxetane) ("poly-BAMO"), poly-azidomethyl-methyloxetane ("poly-AMMO"), nitrocellose, polybutadieneacrylonitrile acrylic acid terpolymer ("PBAN"), and combinations and copolymers thereof. The binder formulations will typically include a curative appropriate for the binder. For example, a polyisocyanate curing agent is typically used with polyglycidyl nitrate, polyoxetanes, polyglycidyl azide, hydroxy-terminated polybutadienes, and polyethers, whereas an epoxy curing agent is typically used with other binders such as PBAN.

Extending into the upper end of the housing 12 is an initiator 16 resting in an annular housing 17. Exemplary initiators 16 include, for example, standard fuse cords, blasting cap (e.g. RP80), electric matches with lead lines, and other known and/or suitable initiators and detonators. Preferably, the initiator 16 is capable of remote activation to place the operator a safe distance from the ordnance 30. The annular housing 17 may be made of various materials, such as acrylics.

Figure 2:
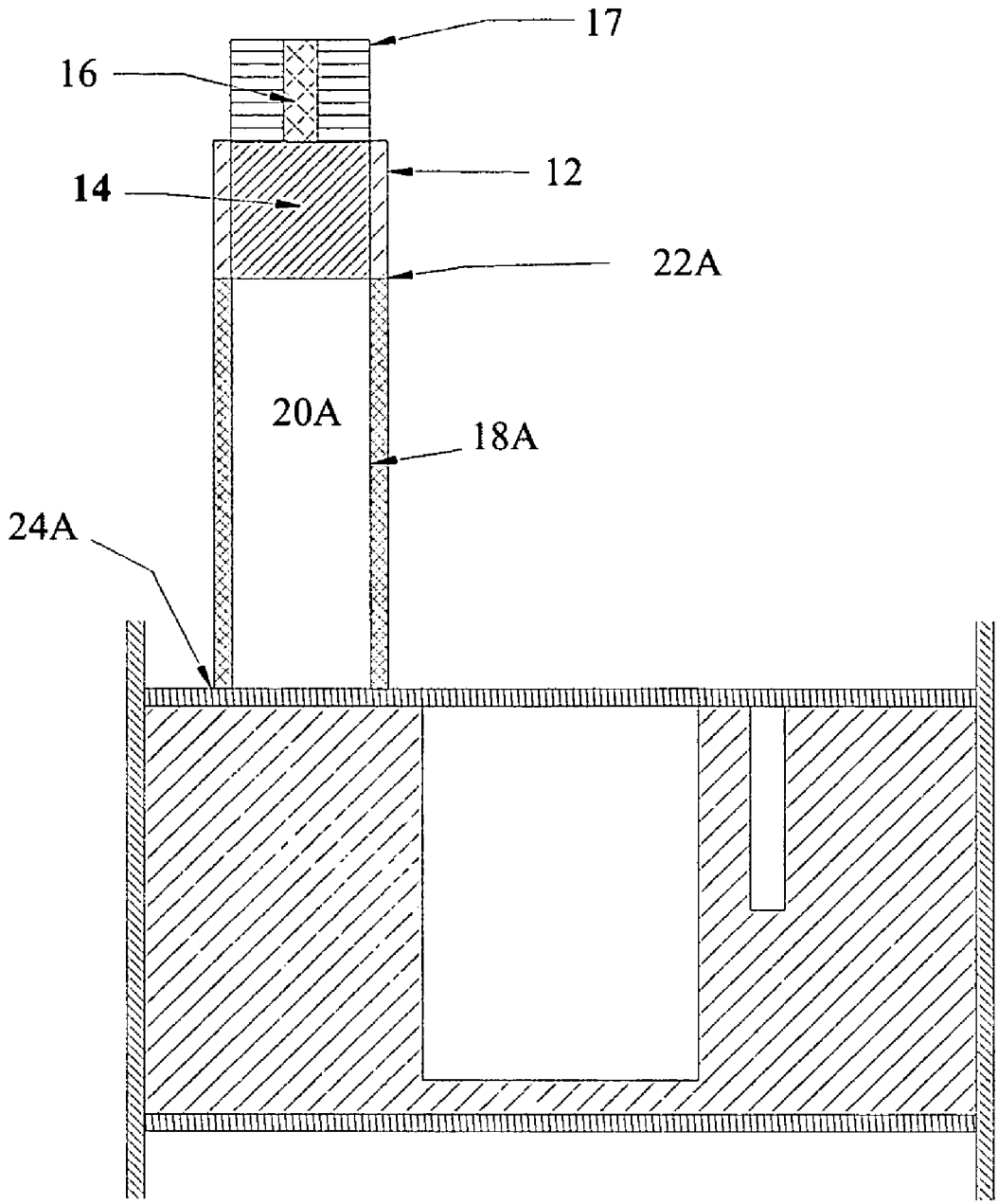
FIG. 2 is a side, cross-sectional view of a mine/UXO neutralizing device according to a second embodiment of the present invention.

An energy-focusing guide 18 is connected below and operative associated with the upper housing 12. An internal passageway 20 extends through the energy-focusing guide 18. The cross-sectional dimension of the internal passageway 30 preferably decreases and/or remains constant from the proximal (top in FIG. 1) end 22 to the distal (bottom in FIG. 1) end 24 of the energy-focusing guide 18. In the embodiment shown in FIG. 1, the internal passageway 20 and exterior surface of the energy-focusing guide 18 continuously tapers at a constant rate from the proximal end 22 to the distal end 24. In the device 10A shown in FIG. 2, the internal passageway 20A and external surface of the energy-focusing guide 18A remain constant in dimension between the proximal end 22A and the distal end 24A. It should be understood that other cross-sectional profiles are possible, such as those comprising tapering and non-tapering portions. Preferably, no region of the internal passageway 20/20A increases in cross-sectional dimension between the opposite ends 22/22A and 24/24A.

The upper housing 12 and the energy-focusing guide 18/18A may be made of the same or different materials, including, for example, metals, alloys, plastics, composites, paper and pulp products, etc. The materials selected are preferably compatible with the intended use environment (e.g., high or low temperature, underwater) of the device 10.

The internal passageway 20/20A comprises and preferably is filled with an ionizable gas. Examples of suitable gases that may be used for the purposes of this invention include air, hydrogen, helium, argon, oxygen, and nitrogen, and combinations thereof.

The device 10/10A of the present invention optionally comprises additional components. For example, according to an embodiment a fuel component, such as aluminum or polytetrafluoroethylene (e.g., TEFLON), may be placed at the distal end 24/24A of the guide 18/18A. The fuel component may take the form of a sheet, foil, particles, etc. The device 10/10A may also comprise a holder, multi-leg support means (e.g., a tripod), bracket, stand, or other mounting device, the purpose of which is elaborated upon below.

In operation, the distal end 24/24A of the mine/UXO-neutralizing device 10/10A preferably is placed in contact with or immediately adjacent the explosive ordnance, which is depicted in the drawings as a landmine 30 comprising a casing 32, and a primary explosive 34. Although not shown, a holder or stand may be provided for mounting the device 10 in contact with or close proximity to the ordnance 30. Optionally, a sealant (e.g., O-ring or epoxy) may be used to form a hermetic seal between the distal end 24/24A of the guide 18/18A and the casing 32.

Upon activation of the igniter 16, the energetic charge 14 in the upper housing 12 is detonated, releasing a shockwave. Without wishing to be bound necessarily by any theory, it is believed that the shockwave passes through gas contained in the energy-focusing guide 18/18A to compress, heat, and accelerate the gas in the direction of the shockwave front motion. The shockwave has an initial "detonation velocity." Detonation velocity is measured for the purposes of this invention in accordance with the technique set forth in John M. McAfee, Blaine W. Asay, A. Wayne Campbell, John B. Ramsay, Proceedings Ninth Symposium on Detonation, OCNR 113291-7 pp. 265-278 (1989). Examples of detonation velocities for many compositions are set forth in *Navy Explosive Handbook: Explosive Effects and Properties Part III,* 1998.

As the shockwave passes through the guide 18/18A and encounters the gas, the shockwave may slow somewhat. If the shockwave passing through the guide 18/18A has an effective velocity to excite gas molecules into a reactive transition state, the gas begins to undergo exothermic decomposition and generate plasma. The velocity needed to generate plasma will depend primarily upon the ionization potential of the gas contained in the energy focusing guide 18/18A. Gas ionization potentials are reported in the CRC Handbook of Chemistry and Physics. For example, in the case of air, the detonation velocity and the effective velocity of the shockwave are preferably at least about 7 mm/μsec (millimeters per microsecond) and about 6 mm/μsec, respectively. Other gases may have higher or slower ionization potential and require different effective velocities.

The velocity of the shockwave as it passes through the gas may be measured as follows. Fiber optic cables with a core diameter of 250 μm are passed perpendicular to the length of the guide through both walls of the guide. One end of the fiber is connected to a laser and the other end is connected to a silicon photodiode. The fiber that is inside the guide has the low-index cladding removed, resulting in a fiber that is exposed to the atmosphere in the guide. Since the index-of-refraction of the atmosphere in the guide, initially air at ambient pressure, is considerably lower than the index-of-refraction of the fused silica core of the fiber, almost all of the laser light coupled to the fiber will remain in the fiber as is passes through the guide. However, when the higher-pressure shock wave passes by the fiber, the index-of-refraction of the air increases to the point that light begins to escape the fiber. This results in a measurable decrease in detected laser light as the shockwave passes the fiber optic. By placing a series of fiber optics at known locations along the length of the guide, the shock velocity in the guide can be calculated by dividing distance the fiber is from the energetic by the arrival time of the shock at the fiber.

The configuration of the energy-focusing guide 18 efficiently captures and channels energy of the plasma on the mine casing 32. The high temperature plasma energy pulse impacts and penetrates through the casing 32 and enters into the primary explosive 34, where the plasma consumes all or most (preferably at least 90 weight percent) of the primary explosive 34 without or before causing an explosive event. In embodiments of the invention, the plasma leaves pulverized primary explosive remnants that are harmless or significantly less dangerous than the pre-neutralized UXO, thereby decreasing the risk of primary or collateral damage from the UXO.

Without wishing to be bound by any theory, it is believed that the plasma initiates deflagration in the explosive, e.g., TNT. Deflagration is a very fast burning mechanism where the burn rate increases as a function of time. This deflagration consumes the entire mass of TNT within a few milliseconds. In contrast, conventional methods consume TNT in a 'fast burn'. The burn rate of a fast burn is constant and is at least an order of magnitude or more slower than a deflagration, resulting in the consumption of the TNT taking seconds or longer.

Advantageously, the construction of the neutralizing devices of embodiments of the present invention require small amounts of energetic charges. For example, according to one experimental test, a mine comprising a 0.25 inch PVC casing and 4.5 pounds of TNT was neutralized (99 weight percent TNT consumption) in less than one second (about 1 to about 5 milliseconds) with a neutralizing device. The neutralizing device comprised a 1 inch diameter/1 inch long housing made of plastic (e.g., acrylic). The housing was loaded with 20 grams of energetic charge comprising 88 weight percent HMX and 12 weight percent binder (5.365 wt % HTPB, 5.365 wt % IDP (isodecylpelarglonate), 0.51 wt % IPDI (isophorone diisocyanate), 0.7 wt % lecithin. The neutralizing device further comprised a polycarbonate cone selected as the energy-focusing guide. The guide had a length of 3 inches and an internal passageway tapering continuously in diameter from 0.5 inches to 1.0 inches. An epoxy adhesive was used to join the distal end of the energy-focusing guide to the ordnance. The non-consumed explosive remnants totaled 1 ounce and were pulverized in the method to particle sizes less than 5 $mm^3$, preferably less than 1 $mm^3$. Without wishing to be bound by any theory, it is believed that the energy-focusing device is primarily responsible for increasing the efficiency of energy delivery to the target so that smaller amounts of energetic charge are required.

The neutralizing device 10 may be manufactured as follows. The initiator 16 is inserted through an aperture in the closed end of the housing 12. Adhesives, mechanical fasteners, tape, or the like may be used to retain the initiator 16 in place. The housing 12 is coupled, preferably with a hermetic seal, to the energy-focusing guide 18/18A using adhesive (e.g., epoxy), mechanical fasteners, or the like. The order for inserting the initiator 16, loading the charge 14, and coupling the energy-focusing guide 18/1 8A is not particularly important, and may be practiced in any sequence.

The neutralizing device and method of the present invention have a wide range of utilities. For example, it is contemplated that the device and method may be practiced in many and diverse environments where mines and UXOs are encountered, such as ground, underground, underwater, and overburden. Further, the neutralizing device of embodiments of the invention is compatible with and will penetrate through most common casing materials, such as steel, aluminum, plastic, and other casings. The relatively inexpensive and compact nature of the device and the simplicity with which it operates makes the present invention ideal for security and humanitarian purposes, such as for neutralizing mines in military and civilian areas. The device also has utility in neutralizing vehicle-based mines and underwater mines.

Additional advantages and modifications will readily occur to those skilled in the art upon reference to this disclosure. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. A method for neutralizing an explosive ordnance, comprising:

activating an energetic charge to produce a shockwave;

imparting the shockwave at an effective velocity and temperature on a gas to ionize the gas for creating plasma and to drive the plasma; and impacting the plasma on a casing of the explosive ordnance containing an explosive to penetrate through the casing using an energy-focusing guide and, at least before causing an explosive event of the explosive within the casing, substantially consuming the explosive.

2. The method according to claim 1, wherein the energetic charge comprises at least 94 weight percent of a nitrate-containing compound.

3. The method according to claim 2, wherein the nitrate-containing compound comprises of nitramine.

4. The method according to claim 2, wherein the energetic charge comprises a nitramine selected from HMX, RDX, and CP-20.

5. The method according to claim 1, wherein the gas comprises air.

6. The method according to claim 5, wherein the energetic charge has a detonation velocity of at least 7 mm/μsec.

7. The method according to claim 5, wherein the effective velocity is at least 6 mm/μsec.

8. The method according to claim 5, wherein the effective temperature is greater than 10,000° C.

9. The method according to claim 5, wherein the effective temperature is greater than 50,000° C.

10. The method according to claim 1, wherein said impacting comprises focusing plasma on the casing with an energy-focusing guide.

11. The method according to claim 1, wherein the energy-focusing guide is cylindrical shaped.

12. The method according to claim 1, wherein the energy-focusing guide is tapered.

13. The method according to claim 1, wherein the energy-focusing guide includes a distal end contacting the casing.

14. The method according to claim 1, wherein the ordnance comprises a mine.

15. A method for neutralizing explosive ordnance, comprising:

activating an energetic charge having a detonation velocity of at least 7 mm/μsec to produce a shockwave;

imparting the shockwave on a gas at an effective velocity of at least 6 mm/μsec and a temperature of at least 10,000° C.; and impacting the gas to a casing of the explosive ordnance containing an explosive to penetrate through the casing using an energy-focusing guide and, at least before causing an explosive event of the explosive within the casing, substantially consuming the explosive.

16. The method according to claim 15, wherein the energetic charge comprises at least 94 weight percent of a nitrate-containing compound.

17. The method according to claim 16, wherein the nitrate-containing compound comprises a member selected from HMX, RDX, and CL-20.

18. The method according to claim 15, wherein said impacting comprises focusing the gas on the casing with a focusing guide.

* * * * *